US006162112A

United States Patent [19]

Miyazaki et al.

[11] Patent Number: 6,162,112

[45] Date of Patent: Dec. 19, 2000

[54] CHEMICAL-MECHANICAL POLISHING APPARATUS AND METHOD

[75] Inventors: Kyoichi Miyazaki, Utsunomiya; Matsuomi Nishimura, Omiya; Kazuo Takahashi, Kawasaki, all of Japan

[73] Assignee: Canon Kabushiki Kaisha, Tokyo, Japan

[21] Appl. No.: 08/883,628

[22] Filed: Jun. 26, 1997

[30] Foreign Application Priority Data

Jun. 28, 1996 [JP] Japan ..... 8-188355
Jul. 10, 1996 [JP] Japan ..... 8-199677

[51] Int. Cl.[7] ..... B24B 1/00

[52] U.S. Cl. ..... 451/36; 451/41; 451/56; 451/72; 451/288

[58] Field of Search ..... 451/36, 41, 56, 451/60, 63, 72, 285, 288, 290

[56] References Cited

U.S. PATENT DOCUMENTS 4,956,944 9/1990 Ando et al. .
5,399,233 3/1995 Murazumi et al. .

FOREIGN PATENT DOCUMENTS 62-45123 2/1987 Japan .
6-252110 9/1994 Japan .

*Primary Examiner*—Timothy V. Eley
*Attorney, Agent, or Firm*—Fitzpatrick, Cella, Harper & Scinto

[57] ABSTRACT

A chemical-mechanical polishing apparatus for polishing a workpiece. The apparatus includes a rotatable table having a surface for holding a workpiece to be polished, a table drive mechanism for rotating the rotating table, a polishing tool rotatable around a rotation axis and being rectilinearly movable in an axial direction along the rotation axis, a polishing tool drive mechanism for rotating and rectilinearly moving the polishing tool, the polishing tool drive mechanism pressing the polishing tool against the workpiece to be polished at a predetermined pressure, a supply for supplying an abrasive material between the polishing tool and the workpiece to be polished, and a foreign substance removing device for removing a foreign substance on the surface of the table. The removing device is located rotationally downstream of the table relative to the polishing tool.

73 Claims, 5 Drawing Sheets

CHEMICAL-MECHANICAL POLISHING APPARATUS AND METHOD

BACKGROUND OF THE INVENTION

1. Field of the Invention

This invention relates to a chemical-mechanical polishing (CMP) apparatus and method for highly accurately polishing a substrate such as a wafer, which is a workpiece.

2. Related Background Art

In recent years, the super minuteness and higher level difference of semiconductor devices have been advanced and along therewith, it has been required to highly accurately flatten the surfaces of substrates such as semiconductor wafers formed of Si, GaAs, InP or the like, and chemical-mechanical polishing apparatuses which will be described below are known as working means for flattening the surfaces of the substrates such as wafers highly accurately.

(1) As shown in FIG. 6 of the accompanying drawings, a chemical-mechanical polishing apparatus is provided with a workpiece rotating table 103 capable of removably holding a substrate 104 such as a semiconductor wafer formed of Si, GaAs, InP or the like on a lower surface shown in the figure, a polishing tool rotating table 101 integrally provided with a polishing pad 102 of a very large diameter as compared with the diameter of the substrate 104 disposed in opposed relationship with the underside of the workpiece rotating table 103, and a supply nozzle 106 for supplying an abrasive material (polishing slurry) 107 to the upper surface of the polishing pad 102, and is designed such that working pressure in the axial direction indicated by the white arrow is imparted to the rotary shaft 105 of the workpiece rotating table 103 holding the substrate 104 while the abrasing material (polishing slurry) 107 is supplied to the upper surface of the polishing pad 102 integrally provided on the polishing tool rotating table 101 rotated in the direction of arrow A, to thereby impart rotational motion indicated by arrow B and pivotal motion indicated by arrow C to the workpiece rotating table 103 holding the substrate 104 with the substrate 104 urged against the polishing pad 102, thus polishing the substrate.

(2) Shown in FIG. 7 of the accompanying drawing, is a chemical-mechanical polishing apparatus in which first to third polishing tool rotating tables 201*a*–201*c* of a very large diameter are juxtaposed on a base 205 and substrates (not shown) such as wafers held on first to third workpiece rotating tables 204*a*–204*c* disposed on a head 203 are polished at one time while being caused to bear against polishing pads 202*a*–202*c* integrally provided on the upper surfaces of the first to third polishing tool rotating tables 201*a*–201*c*, respectively, or the first to third polishing pads 202*a*–202*c* are made to differ in hardness or surface roughness and a substrate W is roughly polished and finish-polished by the first to third polishing pads 202*a*–202*c* and the polished chips are removed.

However, the above-described prior art suffers from the following problems still left to be solved.

(1) Since the diameter of the polishing tool rotating tables integrally provided with the polishing pads is very large as compared with the diameter of the substrate, the entire polishing apparatus including the polishing tool rotating tables becomes bulky, and when the polishing tool rotating tables are rotated at a high speed, vibrations are created and it becomes impossible to highly accurately polish the surface to be polished of the substrate which is a workpiece and therefore, the polishing tool rotating tables cannot be rotated at a high speed. As a result, the polishing speed (the amount of removal per unit time) cannot be made high.

(2) During polishing, foreign substances such as polishing chips cannot be removed and therefore, stable chemical-mechanical polishing cannot be done for a long time. Also, it is difficult to detect the surface shape of the surface to be polished of the substrate which is a workpiece in real time by a detecting device.

SUMMARY OF THE INVENTION

The present invention has been made in view of the above-noted problems peculiar to the prior art and has as its object to realize a chemical-mechanical polishing apparatus and method which can stably effect high-speed and highly accurate chemical-mechanical polishing for a long time.

Consequently, the present invention provides a chemical-mechanical polishing apparatus for effecting polishing while supplying an abrasive material between the surface to be polished of a workpiece and the polishing surface of a polishing tool bearing against said surface to be polished with a predetermined working pressure imparted to said surface to be polished, characterized by the provision of:

a rotatable table rotatable by a rotatable table rotating drive mechanism for holding and rotating said workpiece, a polishing tool rotated and rectilinearly moved in the axial direction thereof by a polishing tool rotating drive mechanism and pressing mechanism and having a diameter smaller than the diameter of said workpiece, and foreign substance removing means for removing any foreign substance on said surface to be polished disposed on the lower part side region in the direction of rotation of said rotatable table relative to said polishing tool effecting polishing.

Also, the present invention provides a chemical-mechanical polishing apparatus for effecting polishing while supplying an abrasive material between the surface to be polished of a workpiece and the polishing surface of a polishing tool bearing against said surface to be polished with a predetermined working pressure imparted to said surface to be polished, characterized by the provision of:

a rotatable table rotatable by a rotatable table rotating drive mechanism for holding and rotating said workpiece, a tool pivotal moving mechanism for supporting and pivotally moving a polishing tool rotated and rectilinearly moved in the axial direction thereof by a polishing tool rotating drive mechanism and pressing mechanism and having a diameter smaller than the diameter of said workpiece, and a scrubber for removing any foreign substance on said surface to be polished disposed on the lower part side region in the direction of rotation of said rotatable table relative to said polishing tool effecting polishing, the removal of the foreign substance by said scrubber being done during the polishing by said polishing tool.

Also, the present invention provides a chemical-mechanical polishing apparatus for effecting polishing while supplying an abrasive material between the surface to be polished of a workpiece and the polishing surface of a polishing tool bearing against said surface to be polished with a predetermined working pressure imparted to said surface to be polished, characterized by the provision of:

a rotatable table rotatable by a rotatable table rotating drive mechanism for holding and rotating said workpiece, a tool conveying mechanism for supporting polishing tools rotated and rectilinearly moved in the axial direction thereof by individually provided polishing tool rotating drive mechanisms and having a diameter smaller than the diameter of a plurality of said workpieces through pivotally movable sliders, selecting one of them and conveying it to a region opposed to said rotatable table, and a scrubber for removing any foreign substance on said surface to be polished disposed on the lower part side region in the direction of rotation of said rotatable table relative to said polishing tool effecting polishing, the direction of pivotal movement of said sliders being the diametrical direction of said rotatable table in a region opposed thereto.

Also, the present invention provides a chemical-mechanical polishing apparatus for effecting polishing while supplying an abrasive material between the surface to be polished of a workpiece and the polishing surface of a polishing tool bearing against said surface to be polished with a predetermined working pressure imparted to said surface to be polished, characterized by the provision of:

a rotatable table for holding and rotating the workpiece rotated by a rotatable table rotating drive mechanism, a polishing tool rotated by a rotating drive mechanism and rectilinearly moved in the axial direction thereof by a pressing mechanism, an abrasive material supplying mechanism for successively selecting one of different kinds of abrasive materials and supplying it onto the surface to be polished of the workpiece held by said rotatable table, and foreign substance removing means for removing the abrasive material and/or any foreign substance on the surface to be polished of the workpiece.

Also, the present invention provides a chemical-mechanical polishing apparatus for effecting polishing while supplying an abrasive material between the surface to be polished of a workpiece and the polishing surface of a polishing tool bearing against said surface to be polished with a predetermined working pressure imparted to said surface to be polished, characterized by the provision of:

a rotatable table for holding and rotating the workpiece rotated by a rotatable table rotating drive mechanism, a polishing tool pivotal moving mechanism for supporting a polishing tool rotated by a rotating drive mechanism and rectilinearly moved in the axial direction thereof by a pressing mechanism, and pivotally moving it in the diametrical direction of the rotatable table, an abrasive material supplying mechanism for successively selecting one of different kinds of abrasive materials and supplying it onto the surface to be polished of the workpiece held by said rotatable table, and a scrubber for removing the abrasive material and/or any foreign substance on the surface to be polished of the workpiece.

Also, the present invention provides a chemical-mechanical polishing method of effecting polishing while supplying an abrasive material between the surface to be polished of a workpiece and the polishing surface of a polishing tool bearing against said surface to be polished with a predetermined working pressure imparted to said surface to be polished, characterized by:

causing the polishing surface of said polishing tool to bear against the surface to be polished of said workpiece with the predetermined working pressure imparted to said surface to be polished in a region opposed to the surface to be polished of said workpiece held by a rotatable table having the polishing tool, which is smaller in diameter than said workpiece, rotating said workpiece and said polishing tool and pivotally moving said polishing tool along the surface to be polished of said workpiece to thereby effect polishing, and simultaneously with said polishing, removing any foreign substance by a scrubber in the lower part side region in the direction of rotation of said surface to be polished of said workpiece relative to said polishing tool effecting the polishing.

Also, the present invention provides a chemical-mechanical polishing method of effecting polishing while supplying an abrasive material between the surface to be polished of a workpiece and the polishing surface of a polishing tool bearing against said surface to be polished with a predetermined working pressure imparted to said surface to be polished, characterized by:

selecting one of the polishing tools, which is smaller in diameter than a plurality of said workpieces supported by a tool conveying mechanism, conveying it to a region opposed to the surfaces to be polished of said workpieces held by a rotatable table, and causing the polishing surface of said selected polishing tool to bear against the surfaces to be polished of said workpieces with the predetermined working pressure imparted to said surfaces to be polished, rotating said workpieces and said selected polishing tool and pivotally moving said polishing tool in the diametrical direction of said rotatable table to thereby effect polishing, and simultaneously with said polishing, removing any foreign substance by a scrubber in the lower part side region in the direction of rotation of said surfaces to be polished of said workpiece relative to said polishing tool effecting the polishing.

Consequently, the present invention can effect the removal of foreign substances such as polishing chips on the surface to be polished of the workpiece in real time by the scrubber during polishing and can therefore, effect stable chemical-mechanical polishing for a long time.

Also, polishing and scrubbing are effected at one time and therefore, it never happens that the throughput of the polishing process for the workpiece is reduced.

Further, one of the polishing tools of a diamer smaller than the diameter of a plurality of workpieces can be selected and conveyed to a region opposed to the rotatable table, and the polishing surface of this conveyed polishing tool can be caused to bear against the surface to be polished of the workpiece held by the rotatable table to thereby effect polishing. Therefore, by successively interchanging said plurality of polishing tools as differing in the surface roughness, hardness, etc., of the polishing surfaces thereof, rough polishing, finish polishing and super-finish polishing can be effected or said plurality of polishing tools are made equal in the surface roughness, hardness, etc., of the polishing surfaces thereof, and can be interchanged one after another to thereby effect stable chemical-mechanical polishing.

Also, the removal of foreign substances such as polishing chips on the surface to be polished of the workpiece can be effected in real time by the scrubber during polishing and therefore, the detection of the polished state can be accomplished highly accurately.

DESCRIPTION OF THE PREFERRED EMBODIMENTS

Figure 1:
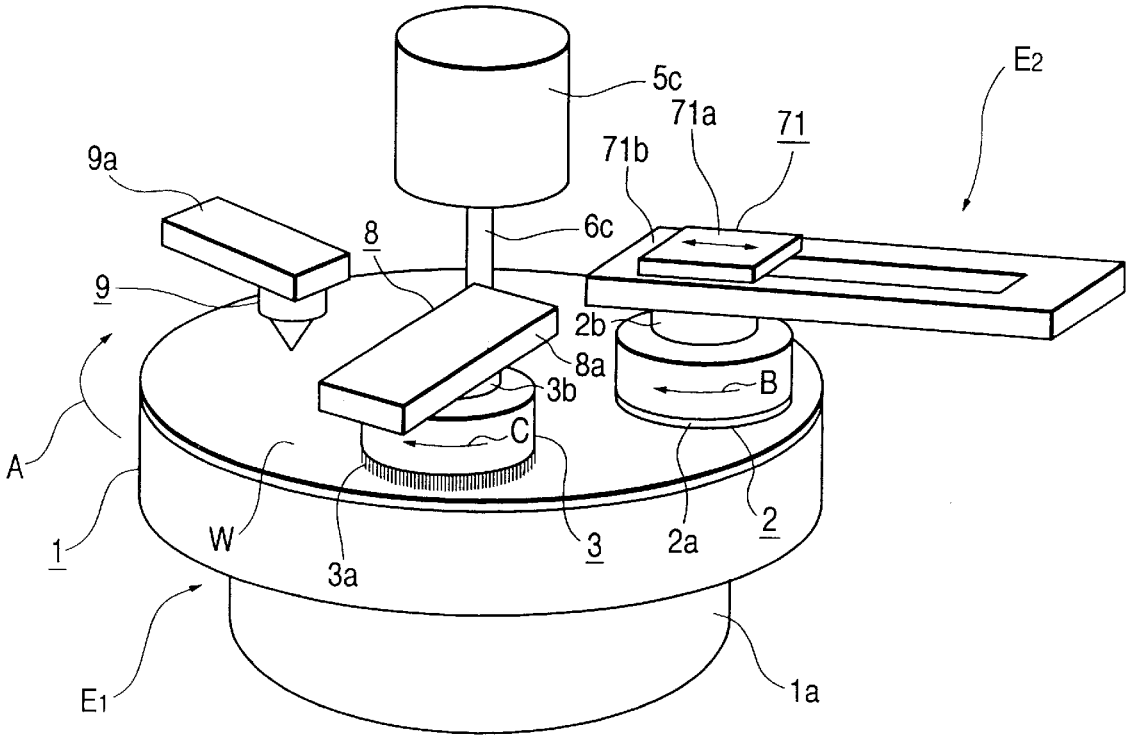
FIG. 1 is a schematic perspective view of a chemical-mechanical polishing apparatus according to a first embodiment of the present invention.

A description will first be made of points common to the first to fourth embodiments of the present invention.

In the present invention, as a plurality of different kinds of abrasive material, use is made of abrasive materials in which the grain diameter of abrasive grains formed of the same material mixed with a polishing solution as will be described later has been varied or abrasive materials of which the abrasive grains are formed of different materials.

In the present invention, each polishing tool rotating drive mechanism and pressing mechanism is made variable in rotational speed and/or pressing force, whereby it can be rotated at a proper rotational speed corresponding to the kind and material of the surface to be polished of a workpiece or proper working pressure can be imparted to the surface to be polished of the workpiece.

Also, as a suitable workpiece to be polished by the polishing method of the present invention, mention may be made of a semiconductor wafer of Si, Ge, GaAs, InP or the like, or a quartz or glass substrate having a plurality of island-like semiconductive areas formed on the surface thereof. A flat surface is required of any of these in order to form wiring and insulative areas patterned by photolithography. Consequently, the surface to be polished is an insulative film or a metallic film or a surface on which they are mixedly present.

It is desirable that as the polishing surface of the polishing tool of the present invention, utilization be made of the surface of a pad of unwoven fabric, foamed polyurethane or the like. Also, the scrubber mechanism of the present invention is not limited to the surface of scrubbing by the use of a brush, but may be for scrubbing by the use of sponge or the like.

As an abrasive material used in the present invention, liquid containing fine particles therein is desirable and specifically, as the fine particles, mention may be made of silica ($SiO_2$), alumina ($Al_2O_3$), manganese oxide ($MnO_2$), cerium oxide (CeO) or the like, and as the liquid, mention may be made of NaOH, KOH, $H_2O_2$ or the like.

The particle diameter of the fine particles may preferably be 8 nm–50 nm, and, for example, by varying the pH of KOH, the degree of cohesion of the particles can be controlled.

In the case of the polishing of the surface of a semiconductor, a silica-dispersed sodium hydroxide solution is preferable, and in the case of the polishing of an insulative film, a silica-dispersed potassium hydroxide solution is preferable, and in the case of a the polishing of metallic film such as tungsten, alumina- or manganese-oxide-dispersed, hydrogen peroxide water is preferable.

When, for example, in the case of the polishing of the surface of a semiconductor, a silica-dispersed NaOH water solution is used as the abrasive material, the silicon surface reacts with NaOH and produces a $Na_2SiO_3$ layer which is a reaction-produced component. This is removed by silica and mechanical polishing using a polishing pad to thereby expose a new silicon surface, whereby reaction progresses. Such a mechanism is called chemical-mechanical polishing.

First Embodiment

A chemical-mechanical polishing apparatus according to a first embodiment, as shown in FIG. 1, is provided with a polishing station $E_1$ provided with a rotatable table 1 for removably holding and rotating a substrate W such as a semiconductor wafer formed of Si, GaAs, InP or the like which is a workpiece, a tool station $E_2$ provided with a tool conveying mechanism 71 for supporting a polishing tool disposed above the polishing station $E_1$ and conveying it to a region opposed to the surface to be polished of the substrate W held by the polishing station $E_1$, a scrubber mechanism 8 for removing any foreign substance such as polishing chips on the wafer W and a detecting device 9 for electrically or optically detecting the polished state of the surface to be polished of the substrate W, which are successively disposed in the lower part side region in the direction of rotation of the rotatable table 1 relative to the polishing tool 2 effecting polishing, and a nozzle 6*c* for supplying an abrasive material (polishing slurry) from an abrasive material (polishing slurry) supply tank 5*c* onto the substrate W.

The polishing station $E_1$ is provided with the rotatable table 1 rotated by a rotatable table rotating drive mechanism 1*a* and is designed to be capable of removably holding and rotating the substrate W on the upper surface of the rotatable table 1.

The tool station $E_2$ is provided with the tool conveying mechanism 71 having a conveying arm 71*b* protruding in the diametrical direction of the rotatable table 1.

A slider 71*a* as a tool pivotal moving mechanism pivotally moved in the lengthwise direction thereof by rectilinearly driving means, not shown, is slidably disposed on the conveying arm 71*b*, and below this slider 71*a* in FIG. 1, there is mounted a polishing tool 2 rotated and rectilinearly moved in the axial direction thereof by a polishing tool rotating drive mechanism and pressing mechanism 2*b*. Thereby, with the conveying arm 71*b*, the polishing tool 2 is conveyed to a region opposed to the surface to be polished of the substrate W held by the polishing tool rotating table 1 and the polishing tool 2 is rectilinearly moved in the axial direction thereof to thereby cause a polishing pad 2*a* to bear against the surface to be polished of the substrate W and with a predetermined working pressure imparted to the surface to be polished, the polishing pad can be pivotally moved in the diametrical direction as a direction along the surface to be polished of the substrate W on the rotatable table 1 or can be spaced apart from the substrate W.

The scrubber mechanism 8 is such that a scrubber 3 having brush hair 3*a* on the underside thereof is integrally provided on the output shaft, not shown, of a scrubber rotating drive mechanism and pressing mechanism 7*b* mounted below a scrubber pivotally moving mechanism 8*a* pivotally movable in the diametrical direction of the rotatable table 1. Thereby, the scrubber 3 is rectilinearly moved in the axial direction thereof and is rotated with the brush hair 3*a* bearing against the surface to be polished of the substrate W and can be pivotally moved in the diametrical direction as a direction along the surface to be polished of the substrate W on the rotatable table 1 or can be spaced apart from the substrate W.

As the detecting device for detecting the polished state, use is made of a thickness measuring device for electrically or optically detecting the partial thickness of the substrate W or the average thickness of the entire substrate W, a surface shape measuring device for detecting the surface shape of the surface to be polished of the substrate W or a terminus detecting device for electrically or optically detecting the terminus of polishing. Specifically, the detecting device 9 is supported by a detecting device scanning mechanism 9*a* and is scanned in the diametrical direction of the substrate W. If this is done, the thicknesses of different regions in the diametrical direction of the substrate W (the distance from the detecting device to the surface of the substrate) can be detected.

Figure 2:
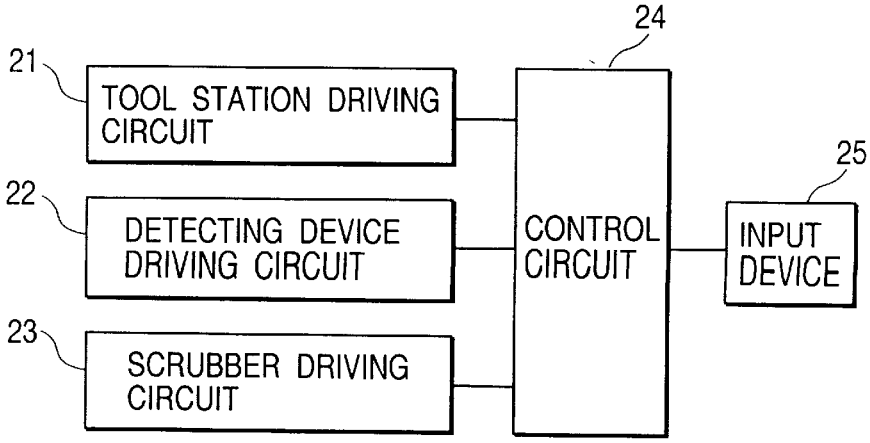
FIG. 2 is a block diagram of the control system of the chemical-mechanical polishing apparatus of the present invention.

FIG. 2 is a block diagram of the control system of the chemical-mechanical polishing apparatus shown in FIG. 1.

The reference numeral 21 designates a tool station driving circuit which governs the operations of moving the polishing tool 2 to a region opposed to the substrate W, rotating it there, and moving it toward a rotary shaft.

The reference numeral 22 denotes a detecting device driving circuit which governs the operation of the detecting device, and the reference numeral 23 designates a scrubber driving circuit which governs the operation of the scrubber.

These driving circuits 21, 22 and 23 have their operations controlled by a control circuit 24 carrying a CPU and a memory thereon.

When an operator inputs information such as the kind of the substrate W and of the polishing tool from an input device 25 such as a keyboard, the control circuit 24 specifies a polishing condition defined on the basis of an experiment or the like and stored in the memory, and supplies the data of driving conditions (for example, the number of revolutions, etc.) to the driving circuits 21, 22 and 23 on the basis of that condition.

A description will now be made of the steps of the chemical-mechanical polishing method of the present invention using the chemical-mechanical polishing apparatus shown in FIG. 1.

(1) The polishing pad 2*a* is mounted on the polishing tool 2. Also, the substrate W is removably held on the rotatable table 1 and rotated.

(2) First, the polishing tool conveying mechanism 71 is started to thereby convey the polishing tool 2 to a region opposed to the surface to be polished of the substrate W.

(3) After the step mentioned in item (2) above, the polishing tool rotating drive mechanism and pressing mechanism 2*b* is started to thereby move the polishing tool 2 in the axial direction thereof toward the substrate W, whereby the polishing pad 2*a* is caused to bear against the surface to be polished of the substrate W with a predetermined working pressure imparted to the surface to be polished and is rotated at a predetermined rotational speed in the direction of arrow B and also is pivotally moved in the diametral direction of the rotatable table 1 and simultaneously therewith, an abrasive material (polishing slurry) is supplied from the abrasive material (polishing slurry) supply tank 5*c* through the nozzle 6*c* between the surface to be polished of the substrate W and that surface of the polishing pad 2*a* which bears against the substrate W, i.e., the polishing surface of the polishing tool, to thereby effect polishing. The direction of rotation of the polishing tool 2 is not always limited to the direction of arrow B, but may be the opposite direction as required.

During this polishing, the scrubber mechanism 8 is started to thereby rectilinearly move the scrubber 3 toward the rotary shaft and cause the brush hair 3*a* thereof to bear against the surface to be polished of the substrate W and rotate it to remove any foreign substance such as polishing chips on the substrate W. In this case, the scrubber 3 may be pivotally moved in the diameticral direction of the rotatable table 1 as required. The direction of rotation of the scrubber 3 is not always limited to the direction of arrow C, but may be the opposite direction as required.

(4) During the polishing and scrubbing operations, the detecting device 9 is scanned in the diametrical direction of the substrate W along the detecting device scanning mechanism 9*a*, whereby the polished state of the surface to be polished of the substrate W is sequentially detected, and if it is judged that the surface to be polished has reached a predetermined polished state, polishing is terminated.

The present embodiment can polish the whole surface of the substrate W by the use of the slider 71*a*. The present embodiment can also be applied to a case where partial polishing is to be effected on only a part needing to be polished.

Second Embodiment

Figure 3:
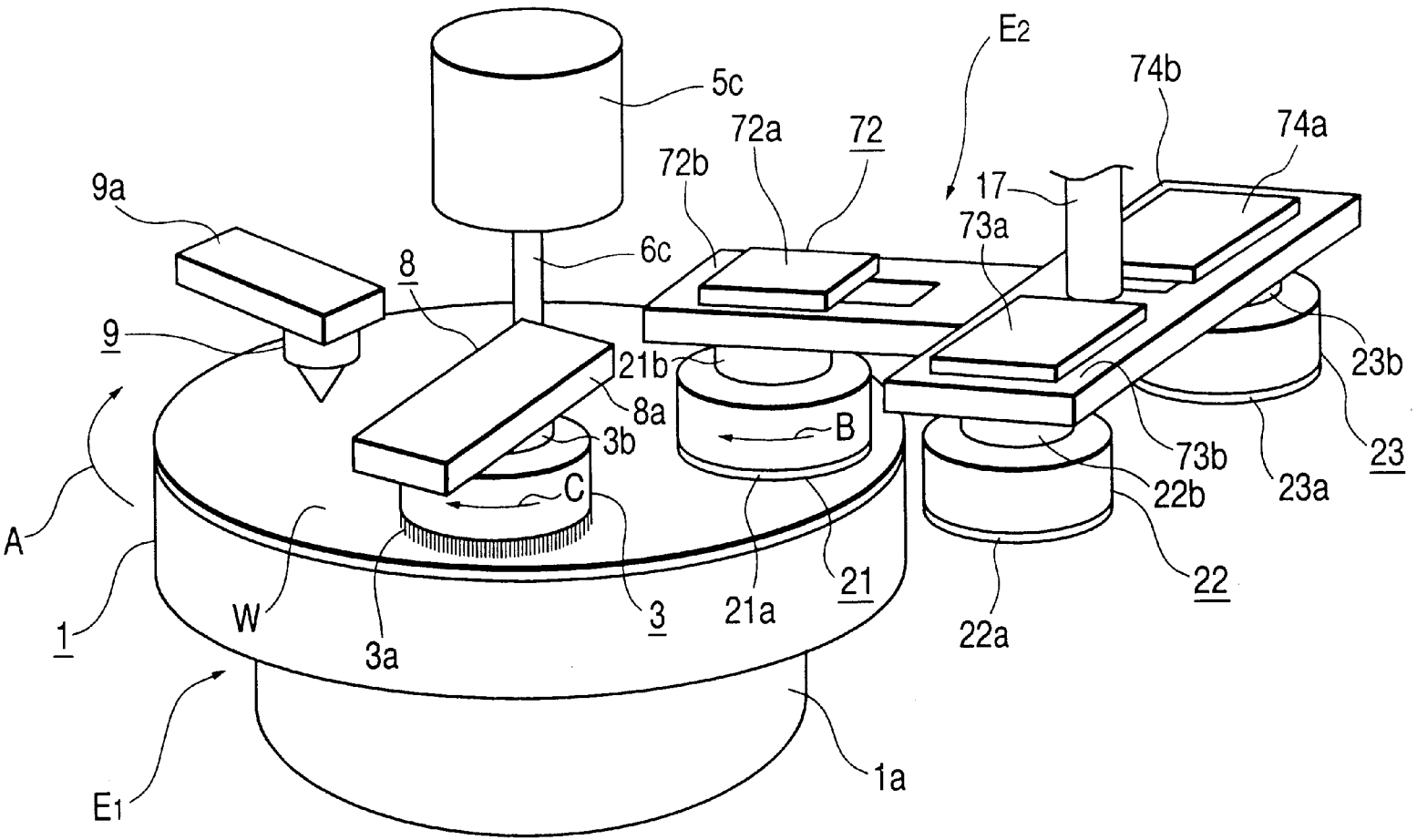
FIG. 3 is a schematic perspective view of a chemical-mechanical polishing apparatus according to a second embodiment of the present invention.

A chemical-mechanical polishing apparatus according to a second embodiment, as shown in FIG. 3, is provided with a polishing station $E_1$ provided with a rotatable table 1 for removably holding and rotating a substrate W such as a semiconductor wafer formed of Si, GaAs, InP or the like, which is a workpiece, a tool station $E_2$ provided with a tool conveying mechanism 72 for supporting a plurality of polishing tools disposed above the polishing station $E_1$ and selecting one of them and conveying it to a region opposed to the surface to be polished of the substrate W held by the polishing station $E_1$, a scrubber mechanism 8 for removing any foreign substance such as polishing chips on the substrate W and a detecting device 9 for electrically or optically detecting the polished state of the surface to be polished of the substrate W, which are successively disposed in the lower part side region in the direction of rotation of the rotatable table 1 relative to the polishing tool effecting polishing, and a nozzle 6*c* for supplying an abrasive material (polishing slurry) from an abrasive material (polishing slurry) supply tank 5*c* onto the substrate W.

The polishing station $E_1$ is provided with the rotatable table 1 rotated by a rotatable table rotating drive mechanism 1*a*, and is designed to be capable of removably holding and rotating the substrate W on the upper surface of the rotatable table 1.

The tool station $E_2$ is provided with a tool conveying mechanism 72 having first to third conveying arms 72*b*, 73*b* and 74*b* protruding in the diametrical direction substantially in a T-shape and integrally provided on the lower end of a rotary shaft 17 rotated by a predetermined angle of rotation by an index mechanism, not shown, and first to third polishing tools 21–23 which will be described later are disposed on the first to third conveying arms 72*b*, 73*b* and 74*b*, respectively, and design is made such that one of the first to third polishing tools 21–23 disposed on the first to third conveying arms 72*b*, 73*b* and 74*b*, respectively, can be selected and conveyed to a region opposed to the surface to be polished of the substrate W held by the rotatable table 1.

The first to third polishing tools 21–23 disposed on the first to third conveying arms 72*b*, 73*b* and 74*b*, respectively, may be of the same construction and therefore, the construction of the first polishing tool 21 disposed on the first conveying arm 72*b* will be described as an example.

A slider 72*a* pivotally movable in the lengthwise direction thereof by rectilinearly driving means, not shown, is slidably disposed on the first conveying arm 72*b*, and the first polishing tool 21 rotated and rectilinearly moved in the axial direction by a first polishing tool rotating drive mechanism and pressing mechanism 21*b* is mounted below this slider 72*a*. Thereby, with the first conveying arm 72*b*, the first polishing tool 21 can be conveyed to the region opposed to the surface to be polished of the substrate W held by the rotatable table 1, and the first polishing tool 21 can be rectilinearly moved in the axial direction thereof and rotated with a first polishing pad 21*a* bearing against the surface to be polished of the substrate W and a predetermined working pressure imparted to the surface to be polished and also can be pivotally moved in the diametrical direction of the rotatable table 1 or can be spaced apart from the substrate W.

The scrubber mechanism 8 and detecting device 9 are of the same construction as those in the first embodiment. The control system also may be similar to that shown in FIG. 2.

A description will now be made of the steps of the chemical-mechanical polishing method of the present invention using the chemical-mechanical polishing apparatus shown in FIG. 3.

(1) The polishing surface of the first polishing pad 21*a* is for rough polishing, the polishing surface of the second polishing pad 22*a* is for finish polishing, and the polishing surface of the third polishing pad 23*a* is for super-finish polishing. Also, the substrate W is removably held on the rotatable table 1 and rotated.

(2) First, the polishing tool conveying mechanism 72 is started to thereby convey the first polishing tool 21 to the region opposed to the surface to be polished of the substrate W.

(3) After the step mentioned in item (2) above, the first polishing tool rotating drive mechanism and pressing mechanism 21*b* is started to thereby move the first polishing tool 21 in the axial direction thereof toward the substrate W, whereby the first polishing pad 21*a* is caused to bear against the surface to be polished of the substrate W with a predetermined working pressure imparted to the surface to be polished and is rotated at a predetermined rotational speed in the direction of arrow B and also is pivotally moved in the diametrical direction of the rotatable table 1 and simultaneously therewith, an abrasive material (polishing slurry) is supplied from the abrasive material (polishing slurry) supply tank 5*c* through the nozzle 6*c* to between the surface to be polished of the substrate W and that surface of the first polishing pad 21*a* which bears against the substrate W, i.e., the polishing surface of the polishing tool, to thereby effect rough polishing.

During this rough polishing, the scrubber mechanism 8 is started to thereby rectilinearly move the scrubber 3 and cause the brush hair 3*a* thereof to bear against the surface to be polished of the substrate W and rotate it, thus removing any foreign substance such as polishing chips on the substrate W. In this case, the scrubber 3 may be pivotally moved in the diametrical direction of the rotatable table 1 as required.

(4) After the step mentioned in item (3) above, the detecting device 9 is scanned in the diametrical direction of the substrate W along the detecting device scanning mechanism 9*a*, whereby the polished state of the surface to be polished of the substrate W is sequentially detected, and when the surface to be polished reaches the predetermined terminus of rough polishing, the rough polishing is terminated.

(5) After the step mentioned in item (4) above, the first polishing tool 21 is axially moved and spaced apart from the substrate W, and then the tool conveying mechanism 72 is started to thereby convey the second polishing tool 22 to the region opposed to the surface to be polished of the substrate W, and finish polishing is effected in a procedure similar to that of item (3) above.

(6) After the step mentioned in item (5) above, the detecting device 9 is scanned in the diametrical direction of the substrate W along the detecting device scanning mechanism 9*a* and the polished state of the surface to be polished of the substrate W is sequentially detected, and when the surface to be polished reaches the predetermined terminus of finish polishing, the finish polishing is terminated.

(7) After the step mentioned in item (6) above, the second polishing tool 22 is axially moved and spaced apart from the substrate W, and the tool conveying mechanism 72 is started and is rotated by a predetermined angle, whereby the third polishing tool 23 is conveyed to the region opposed to the surface to be polished of the substrate W, and super-finish polishing is effected in a procedure similar to that of item (3) above.

(8) After the step mentioned in item (7) above, the detecting device 9 is scanned in the diametrical direction of the substrate W along the detecting device scanning mechanism whereby the surface shape of the surface to be polished of the substrate W is sequentially detected, and when the surface to be polished reaches the predetermined terminus of super-finish polishing, the super-finish polishing is terminated.

The present embodiment can polish the whole surface of the substrate by the use of sliders 72*a*, 73*a* and 74*a*. Also, the present embodiment can be applied to a case where partial polishing is to be effected on only a part needing to be polished.

In the above-described second embodiment, there has been shown a tool conveying mechanism provided with three polishing tools differing in the surface roughness and hardness of the polishing surface from one another, whereas this is not restrictive, but the tool conveying mechanism can be provided with two or four or more polishing tools as required. Also, the plurality of polishing tools can be made equal to one another in the surface roughness and hardness thereof and can be interchanged one after another to thereby effect stable chemical-mechanical polishing. Further, the plurality of polishing tools may differ in size (diameter) from one another. Also, the surface roughness and hardness of the plurality of polishing tools in that case can be arbitrarily selected.

The present invention is constructed as described above and therefore achieves the following effects.

It is unnecessary to make the rotational speed of the polishing tools equal to the rotational speed of the rotatable table for supporting and rotating the workpiece and therefore, it becomes possible to arbitrarily set the rotational speed of the polishing tools correspondingly to the kind of the workpiece and the material of the surface to be polished, and efficient polishing can be accomplished.

Also, during polishing, any foreign substance such as polishing chips on the surface to be polished of the workpiece can be removed in real time and therefore, stable chemical-mechanical polishing can be effected for a long time without the throughput being reduced.

Third Embodiment

Figure 4:
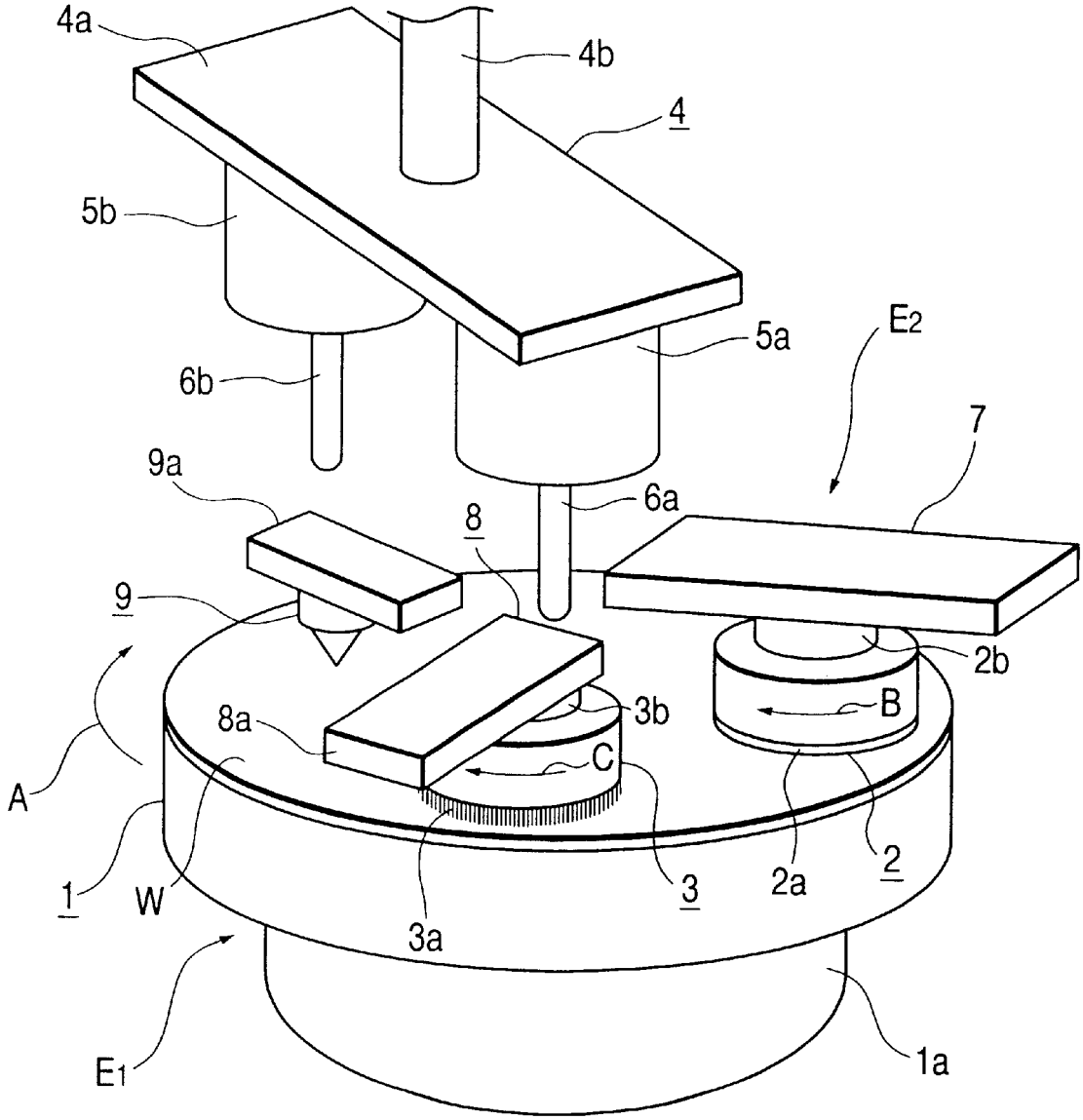
FIG. 4 is a schematic perspective view of a chemical-mechanical polishing apparatus according to a third embodiment of the present invention.

A chemical-mechanical polishing apparatus according to a third embodiment, as shown in FIG. 4, is provided with a polishing station $E_1$ provided with a rotatable table 1 for removably holding and rotating a substrate W such as a semiconductor wafer formed of Si, GaAs, InP or the like, which is a workpiece, a tool station $E_2$ disposed above the polishing station $E_1$, a scrubber mechanism 8 and a detecting device 9 successively disposed in the lower part side region in the direction of rotation of the rotatable table 1 relative to the tool station $E_2$, and a polishing agent supply mechanism 4 capable of successively selecting and alternatively supplying a first abrasive material stored in a first abrasive material supply tank 5*a* and a second abrasive material stored in a second abrasive material supply tank 5*b*.

The polishing station $E_1$ is provided with the rotatable table 1 rotated by a rotatable table rotating drive mechanism 1*a*, and is designed to be capable of removably holding and rotating the substrate W on the upper surface of the rotatable table 1.

As already described in the second embodiment, the polishing process can be divided into rough polishing, finish polishing and super-finish polishing, and these are possible not only by selecting the surface roughness and hardness of the polishing pad used, but also by selecting the particle diameter of the particles in the abrasive material. When, for example, rough polishing is to be effected by selecting the particle diameter of the particles in the abrasive material, particles chiefly of the order of 100 $\mu$m are used in the rough polishing. Also, particles of the order of 1 $\mu$m or less are used in super-finish polishing. By thus selecting the particle diameter of the particles, the above-described polishing steps are effected, but if the particles of the polishing agent used in the rough polishing or the finish polishing remain when the super-finish polishing is effected, polishing may be done more than necessary.

In the present embodiment, the tool station $E_2$ is provided with a polishing tool pivotally moving mechanism 7 pivotally movable in the diametrical direction of the rotatable table 1, and a polishing tool 2 rotated and rectilinearly moved in the axial direction thereof by a polishing tool rotating drive mechanism and pressing mechanism 2*b* supported by the underside of the polishing tool pivotally moving mechanism 7, and has a polishing pad 2*a* integrally provided on the underside of the polishing tool 2, and is designed such that the polishing tool 2 can be rectilinearly moved in the axial direction thereof to thereby cause the polishing pad 2*a* to bear against the substrate W and rotate it with a predetermined working pressure imparted to the substrate W and can be pivotally moved in the diametrical direction of the rotatable table 1 or can be spaced apart from the substrate W.

The scrubber mechanism 8 is such that a scrubber 3 having brush hair 3*a* on the underside thereof is integrally provided on the output shaft, not shown, of a scrubber rotating drive mechanism and pressing mechanism 3*b* mounted on the underside of a scrubber pivotally moving mechanism 8*a* pivotally movable in the diametrical direction of the rotatable table 1, and the scrubber mechanism can be rectilinearly moved in the axial direction thereof and rotated with the brush hair 3*a* bearing against the substrate W and also can be pivotally moved in the diametrical direction of the rotatable table 1 or can be spaced apart from the substrate.

As the detecting device 9, use is made of a measuring device for electrically or optically detecting the surface shape and/or film thickness of the substrate W or a detecting device for detecting the terminus (the final point) of polishing by another method. The detecting device 9 is supported by a detecting device scanning mechanism 9*a* and is scanned in the diametrical direction of the substrate W, whereby the surface shapes and/or film thicknesses of different regions of the substrate W in the diametrical direction thereof can be detected.

Further, the polishing agent supply mechanism 4 is provided with a support member 4*a* integrally provided on the lower end of a rotary shaft 4*b* rotated by a predetermined angle of rotation (in the present embodiment, about 180°) each by an index mechanism, not shown, and a first abrasive material supply tank 5*a* for storing a first abrasive material therein and a second abrasive material supply tank 5*b* for storing a second abrasive material therein, the first and second abrasive material supply tanks 5*a* and 5*b* being mounted on the opposite sides of the rotary shaft 4*b* on the underside of the support member 4*a*, and is designed such that when a first nozzle 6*a* communicating with the first abrasive material supply tank 5*a* is conveyed to a region opposed to the rotatable table 1, the first abrasive material can be supplied onto the substrate W and when conversely, a second nozzle 6*b* communicating with the second abrasive material supply tank 5*b* is conveyed to the region opposed to the rotatable table 1, the second abrasive material can be supplied onto the substrate W.

The rotating drive mechanism and pressing mechanism for the polishing tool are not limited to the rotating drive mechanism and pressing mechanism shown in the above-described embodiment, but can be constructed such that the polishing tool rotated by the rotating drive mechanism is supported by the pressing mechanism and with the rotating drive mechanism, the polishing tool is rectilinearly moved in the axial direction thereof. The scrubber rotating drive mechanism and pressing mechanism can also be constructed such that a rotatable brush rotated by the rotating drive mechanism is supported and rectilinearly moved in the axial direction thereof by the pressing mechanism.

Also, it is preferable that the polishing tool, the scrubber and the detecting device during polishing be disposed substantially concentrically with one another.

A description will now be made of the steps of the chemical-mechanical polishing method of the present invention using the chemical-mechanical polishing apparatus shown in FIG. 4.

(1) The substrate W is removably held on the upper surface of the rotatable table 1, and the rotatable table rotating drive mechanism 1*a* is started to thereby rotate the rotatable table in the direction of arrow A. Also, the polishing agent supply mechanism 4 is rotated by a predetermined angle of rotation and the first nozzle 6*a* communicating with the first abrasive material supply tank 5*a* storing therein the first abrasive material to be supplied at first is conveyed to and positioned at the region opposed to the substrate W held by the rotatable table 1, by positioning means, not shown. In FIG. 4, the nozzles for supplying the abrasive materials are disposed between the polishing tool and the detecting device, but may be disposed between the polishing tool and the detecting device and nearer to the polishing tool as required.

(2) After the step mentioned in item (2) above, the polishing tool rotating drive mechanism and pressing mechanism 2*b* is started to thereby rotate the polishing tool 2 in the direction of arrow B and move the polishing tool in the axial direction thereof, and cause the polishing pad 2*a* to bear against the surface to be polished of the substrate W with a predetermined working pressure imparted to the surface to be polished and pivotally move it in the diametrical direction of the rotatable table 1, and polishing is effected while the first abrasive material is supplied from the first nozzle 6*a*.

In the present step, as required, the scrubber rotating drive mechanism and pressing mechanism 34 may be started to thereby rotate the rotatable brush 3 at a predetermined rotational speed in the direction of arrow C and move the rotatable brush 3 in the axial direction thereof and cause the brush hair 3*a* to bear against the surface to be polished of the substrate W with a predetermined working pressure imparted to the surface to be polished and pivotally move it in the diametrical direction of the rotatable table 1, whereby any foreign substance such as polishing chips on the substrate W can be removed in real time.

(3) After the step mentioned in item (2) above, the detecting device 9 is scanned in the diametrical direction of the substrate W by the detecting device scanning mechanism 9*a*, whereby the surface shape of the surface to be polished of the substrate W is sequentially detected, and when the surface shape and/or film thickness of the surface to be polished reaches the preset terminus of the polishing by the first polishing agent, the supply of the first polishing agent from the first nozzle 6*a* is stopped and the polishing by the first polishing agent is terminated.

(4) After the step of item (3) above, the polishing agent supply mechanism 4 is restarted and is rotated by a predetermined angle of rotation (in the present embodiment, about 180°) and the second nozzle 6*b* communicating with the second abrasive material supply tank 5*b* storing therein the second abrasive material to be supplied next is conveyed to and positioned at the region opposed to the substrate W held by the rotatable table 1.

When in the step of item (2) above, the removal of the foreign substance on the substrate W by the scrubber mechanism 8 is being effected, it is continued, or when the removal of the foreign substance on the substrate W by the scrubber mechanism 8 is not being effected, the rotatable brush 3 is caused to bear against the surface to be polished of the substrate W with a predetermined pressure force imparted to the surface to be polished by a procedure similar to the procedure described in the step of item (2) above and is rotated at a predetermined rotational speed in the direction of arrow C and pivotally moved in the diametrical direction of the rotatable table 1, thereby removing the first abrasive material remaining on the substrate W.

(5) After the step of item (4) above, the second abrasive material is supplied from the second nozzle 6*b* onto the substrate W, whereby the polishing by the second abrasive material is effected.

Again in this step, the removal of the foreign substance on the substrate W by the scrubber mechanism 8 similar to the step of item (2) above can be effected in real time.

The present embodiment, like the first and second embodiments, may be used not only for the polishing of the whole surface of the substrate, but also for the partial polishing which is the polishing of only a part of the substrate.

Fourth Embodiment

Figure 5:
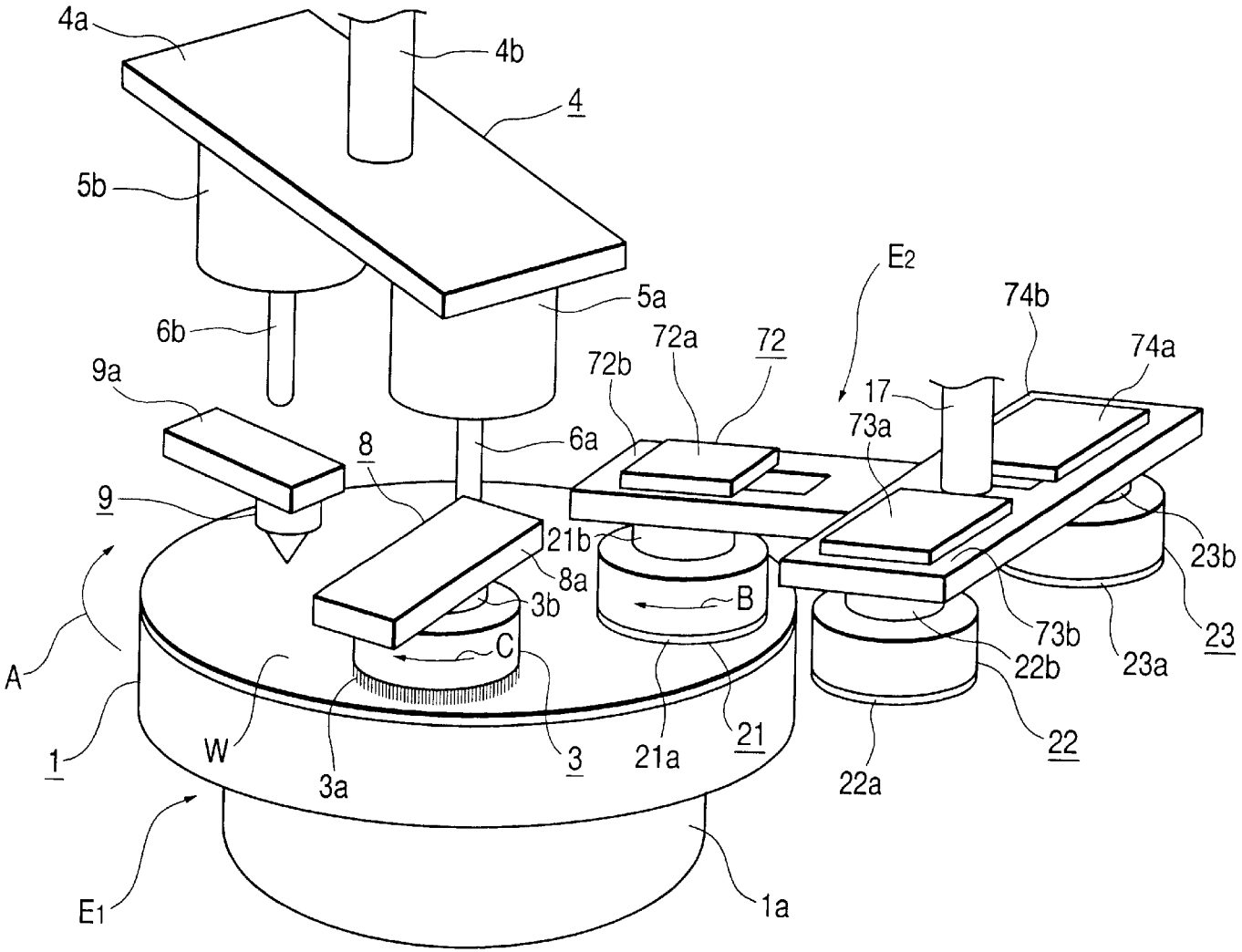
FIG. 5 is a schematic perspective view of a chemical-mechanical polishing apparatus according to a fourth embodiment of the present invention.
Figure 6:
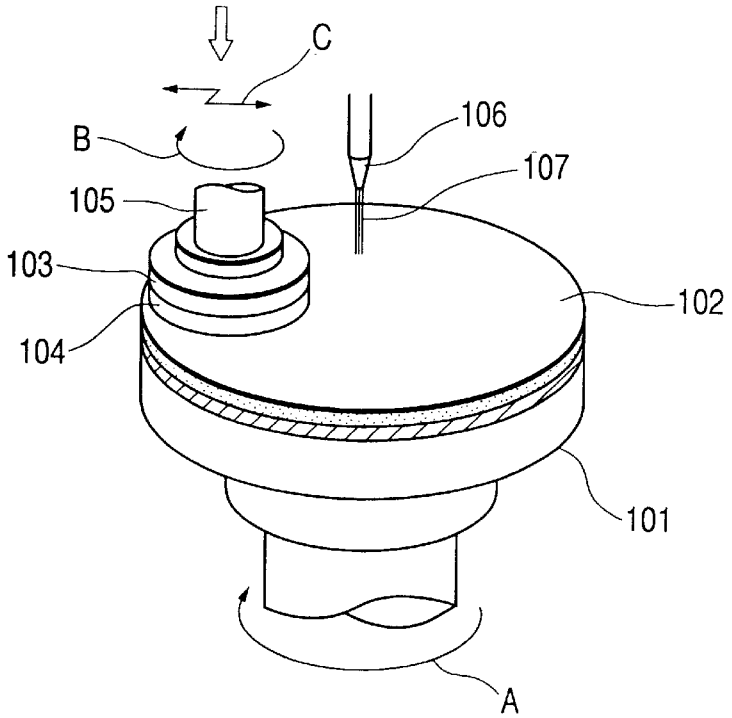
FIG. 6 is a schematic perspective view showing an example of the chemical-mechanical polishing apparatus according to the prior art.
Figure 7:
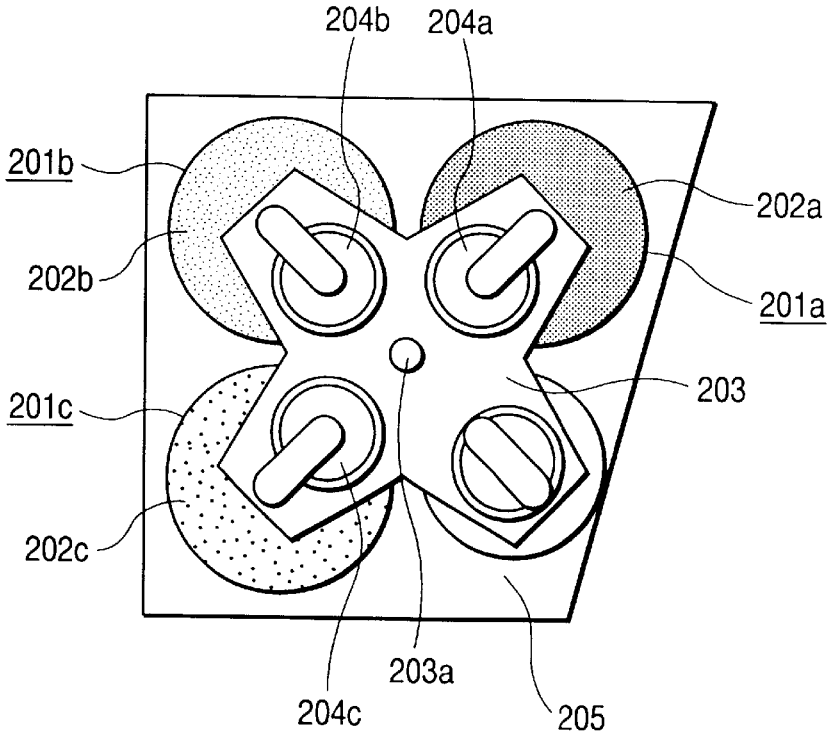
FIG. 7 is a schematic plan view showing another example of the chemical-mechanical polishing apparatus according to the prior art.

As shown in FIG. 5, a fourth embodiment is one in which the abrasive material supply tank 5*c* in the third embodiment is replaced by the plurality of abrasive material supply mechanisms 4 described in the first embodiment. In the fourth embodiment, different kinds of abrasive materials are suitably supplied during polishing an optimum one of the plurality of polishing tools of the tool station $E_2$ having a plurality of polishing tools is sequentially selected and the substrate W is polished. At this time, the optimum combination of an abrasive material and a polishing tool can be selected by the use of the control system of the chemical-mechanical polishing apparatus described in the second embodiment. Also, the plurality of polishing pads, as described in the third embodiment, may differ in the polishing capability thereof, i.e., the surface roughness and hardness or the diameter of the polishing pad, or may be ones equal in the polishing capability but prepared with a view to effect stable chemical-mechanical polishing by successively interchanging the polishing tools.

Also, in the present embodiment, there are provided a plurality of polishing tools and a plurality of abrasive material supply tanks and therefore, even if the substrate W to be polished is changed to another different substrate, a polishing tool and an abrasive material can be readily selected for the newly changed substrate. As a result, there is the effect that working efficiency can be improved when a plurality of substrates are polished on end. At this time, a polishing tool and an abrasive material may be selected for each substrate, but an abrasive material supply mechanism driving circuit, not shown, can be newly connected to the control circuit 24 shown in the first embodiment and instructions can be inputted by the input device 25.

The present embodiment, like the first to third embodiments, can be used not only for the polishing of the whole surface of the substrate, but also for the partial polishing effected on only a part of the substrate.

The present invention is constructed as described above and therefore, there can be achieved the effects as will be described below.

Simply by sequentially changing the kind of the abrasive material to be supplied during the polishing by the same polishing tool, the polishing condition between the surface to be polished of the workpiece and the polishing surface of the polishing tool can be changed. As a result, the polishing condition can be successively changed to that for rough polishing, that for finish polishing, etc., without the operation of the chemical-mechanical polishing apparatus being interrupted, thereby accomplishing stable chemical-mechanical polishing, and productivity is remarkably improved.

The rotational speed of the polishing tool can be made equal to or different from the rotational speed of the rotatable table supporting and rotating the workpiece and therefore, it becomes possible to arbitrarily set the rotational speed of the polishing tool correspondingly to the kind of the workpiece and the material of the surface to be polished, and efficient polishing can be accomplished.

Also, simply by changing the kind of the abrasive material to be supplied without interrupting the operation of the chemical-mechanical polishing apparatus, the polishing condition can be changed during polishing and therefore, stable chemical-mechanical polishing can be effected for a long time and productivity is remarkably improved.

Fifth Embodiment

Although not shown, a fifth embodiment is one in which a nozzle communicating with each abrasive material supply tank shown in the first to fourth embodiments is made integral with each polishing tool to thereby supply the abrasive material from substantially the center of the polishing pad to the surface to be polished through the polishing tool. At this time, the abrasive material is supplied from one or more abrasive material supply tanks to a polishing tool. When the abrasive materials are supplied from a plurality of abrasive material supply tanks to a polishing tool, it is preferable that the abrasive material supply ports of the nozzle provided to the polishing tool to supply the abrasive material onto the substrate be discretely provided for a plurality of abrasive material supply tanks. This is because if a common abrasive material supply port is provided for different kinds of abrasive materials, the different kinds of abrasive materials will mix together in that portion and as a result, an unexpected change in the polishing condition will be brought about. By the present embodiment, the abrasive material is supplied from the polishing tool onto the substrate and therefore, an appropriate quantity of fresh abrasive material is always supplied between the polishing tool and the substrate being polished. At this time, the abrasive material having come out of the polishing tool is quickly removed from the wafer by the scrubber.

Consequently, the present embodiment not only can minimize the consumption of the abrasive material, but also can eliminate any abrasive material having come out of the polishing tool from the substrate on the spot and therefore, the particles of the abrasive material can be prevented from attaching onto the substrate.

Further, by the abrasive material being supplied through the polishing tool, a fluid such as pure water can be used instead of or in addition to the scrubber as foreign substance removing means to remove any foreign substance on the surface to be polished. If in the apparatus construction of FIG. 5, use is made of means for supplying a fluid to wash away any foreign substance, instead of the scrubber, there has been the possibility of the abrasive material being also washed away together. In contrast, if the abrasive material is supplied through the polishing tool as described above, such a fear will disappear.

The present embodiment, like the first to fourth embodiments, can be used for the partial polishing effected on only a part of the surface of the substrate.

What is claimed is:

1. A chemical-mechanical polishing apparatus for polishing a workpiece, said apparatus comprising:

a rotatable table having a surface for holding a workpiece to be polished;

a table drive mechanism for rotating said rotatable table;

a polishing tool rotatable around a rotation axis and being rectilinearly movable in an axial direction along the rotation axis;

a polishing tool drive mechanism for rotating and rectilinearly moving said polishing tool, said polishing tool drive mechanism pressing said polishing tool against the workpiece to be polished at a predetermined pressure;

means for supplying an abrasive material between said polishing tool and the workpiece to be polished; and foreign substance removing means for removing a foreign substance on the surface of said table, said removing means being located rotationally downstream of said table relative to said polishing tool.

2. A chemical-mechanical polishing apparatus for polishing a workpiece, said apparatus comprising:

a rotatable table having a surface for holding a workpiece to be polished;

a table drive mechanism for rotating said rotatable table;

a polishing tool rotatable around a rotation axis and being rectilinearly movable in an axial direction along the rotation axis;

a polishing tool drive mechanism for rotating and rectilinearly moving said polishing tool, said polishing tool drive mechanism pressing said polishing tool against the workpiece to be polished at a predetermined pressure; and a scrubber for removing a foreign substance on the surface of said table, said scrubber being located rotationally downstream of said table relative to said polishing tool, the removal of the foreign substance by said scrubber being done during the polishing by said polishing tool.

3. A chemical-mechanical polishing apparatus for polishing a workpiece, said apparatus comprising:

a rotatable table having a surface for holding a workpiece to be polished;

a tool conveying mechanism for supporting a plurality of polishing tools, for selecting one of the plurality of polishing tools and for conveying the selected tool to a position opposing said rotatable table;

individually provided polishing tool rotating drive mechanisms being rotatable around a rotation axis and being rectilinearly movable in an axial direction along the rotation axis for rotating and rectilinearly driving a respective one of the plurality of the polishing tools; and a scrubber for removing a foreign substance on the surface of said table, said scrubber being located rotationally downstream of said table relative to said polishing tool.

4. A chemical-mechanical polishing apparatus for polishing a workpiece, said apparatus comprising:

a rotatable table having a surface for holding a workpiece to be polished;

a polishing tool rotatable around a rotation axis and being rectilinearly movable in an axial direction along the rotation axis;

a drive mechanism for rotating and rectilinearly moving said polishing tool;

an abrasive material supplying mechanism for selecting one of a plurality of different kinds of abrasive materials and for successively supplying the selected one of the abrasive materials onto the surface to be polished of the workpiece held by said rotatable table; and foreign substance removing means for removing at least one of the abrasive material and a foreign substance on the surface to be polished of the workpiece.

5. A chemical-mechanical polishing apparatus for polishing a workpiece, said apparatus comprising:

a rotatable table having a surface for holding a workpiece to be polished;

a polishing tool rotatable around a rotation axis and being rectilinearly movable in an axial direction along the rotation axis;

a polishing tool drive mechanism for rotating and rectilinearly moving said polishing tool, said polishing tool drive mechanism pressing said polishing tool against the workpiece to be polished at a predetermined pressure, and for pivotally moving said polishing tool in the diametrical direction of said rotatable table;

an abrasive material supplying mechanism for selecting one of a plurality of different kinds of abrasive materials and for successively supplying the selected one of the abrasive materials onto the surface to be polished of the workpiece held by said rotatable table; and a scrubber for removing at least one of the abrasive material and a foreign substance on the surface to be polished of the workpiece.

6. A chemical-mechanical polishing apparatus according to claim 1 or 4, wherein said foreign substance removing means is a scrubber.

7. A chemical-mechanical polishing apparatus according to claim 6, further comprising a scrubber rotating drive mechanism and pressing mechanism supported by a scrubber pivotally moving mechanism pivotally movable in the diametrical direction of the rotatable table, said scrubber rotating drive mechanism and pressing mechanism rotating and rectilinearly moving said scrubber in rotational and axial directions, respectively.

8. A chemical-mechanical polishing apparatus according to claim 6, further comprising a detecting device, opposing the surface of the workpiece being polished, for detecting the polished state of the workpiece being polished.

9. A chemical-mechanical polishing apparatus according to claim 6, further comprising a rotatable brush supported by the scrubber.

10. A chemical-mechanical polishing apparatus according to claim 6, wherein said polishing tool polishes the entirety of the surface to be polished of the workpiece.

11. A chemical-mechanical polishing apparatus according to claim 6, wherein said polishing tool polishes a portion of the surface to be polished of the workpiece.

12. A chemical-mechanical polishing apparatus according to claim 6, wherein said polishing tool has a sponge.

13. A chemical-mechanical polishing apparatus according to claim 6, wherein said polishing tool has a brush.

14. A chemical-mechanical polishing apparatus according to any one of claims 2, 3 and 5, further comprising a scrubber rotating drive mechanism and pressing mechanism supported by a scrubber pivotally moving mechanism pivotally movable in the diametrical direction of the rotatable table, said scrubber rotating drive mechanism and pressing mechanism rotating and rectilinearly moving said scrubber in rotational and axial directions, respectively.

15. A chemical-mechanical polishing apparatus according to claim 14, further comprising a detecting device, opposing the surface of the workpiece being polished, for detecting the polished state of the workpiece being polished.

16. A chemical-mechanical polishing apparatus according to claim 14, further comprising a rotatable brush supported by the scrubber.

17. A chemical-mechanical polishing apparatus according to claim 14, wherein said polishing tool polishes the entirety of the surface to be polished of the workpiece.

18. A chemical-mechanical polishing apparatus according to claim 14, wherein said polishing tool polishes a portion of the surface to be polished of the workpiece.

19. A chemical-mechanical polishing apparatus according to claimed 14, wherein said polishing tool has a brush.

20. A chemical-mechanical polishing apparatus according to claim 14, wherein said polishing tool has a sponge.

21. A chemical-mechanical polishing apparatus according to any one of claims 1 to 5, further comprising a detecting device for detecting the polished state of the workpiece being polished.

22. A chemical-mechanical polishing apparatus according to claim 21, wherein said detecting device is movable with respect to a diametrical direction of a surface of the workpiece to be polished.

23. A chemical-mechanical polishing apparatus according to claim 22, wherein said polishing tool polishes the entirety of the surface to be polished of the workpiece.

24. A chemical-mechanical polishing apparatus according to claim 22, wherein said polishing tool has a brush.

25. A chemical-mechanical polishing apparatus according to claim 22, wherein said polishing tool has a sponge.

26. A chemical-mechanical polishing apparatus according to claim 22, wherein said polishing tool polishes a portion of the surface to be polished of the workpiece.

27. A chemical-mechanical polishing apparatus according to claim 21, wherein said polishing tool polishes the entirety of the surface to be polished of the workpiece.

28. A chemical-mechanical polishing apparatus according to claim 21, wherein said polishing tool has a brush.

29. A chemical-mechanical polishing apparatus according to claim 21, wherein said polishing tool has a sponge.

30. A chemical-mechanical polishing apparatus according to claim 21, wherein said polishing tool polishes a portion of the surface to be polished of the workpiece.

31. A chemical-mechanical polishing apparatus according to any one of claims 2, 3 and 5, further comprising a rotatable brush supported by the scrubber.

32. A chemical-mechanical polishing apparatus according to claim 31, wherein said polishing tool polishes the entirety of the surface to be polished of the workpiece.

33. A chemical-mechanical polishing apparatus according to claim 31, wherein said polishing tool polishes a portion of the surface to be polished of the workpiece.

34. A chemical-mechanical polishing apparatus according to claim 31, wherein said polishing tool has a brush.

35. A chemical-mechanical polishing apparatus according to claim 31, wherein said polishing tool has a sponge.

36. A chemical-mechanical polishing apparatus according to any one of claims 1 to 5, wherein said polishing tool polishes the entirety of the surface to be polished of the workpiece.

37. A chemical-mechanical polishing apparatus according to claim 36, wherein said polishing tool has a brush.

38. A chemical-mechanical polishing apparatus according to claim 36, wherein said polishing tool has a sponge.

39. A chemical-mechanical polishing apparatus according to any one of claims 1 to 5, wherein said polishing tool polishes a portion of the surface to be polished of the workpiece.

40. A chemical-mechanical polishing apparatus according to claim 39, wherein said polishing tool has a brush.

41. A chemical-mechanical polishing apparatus according to claim 39, wherein said polishing tool has a sponge.

42. A chemical-mechanical polishing apparatus according to any one of claims 1 to 5, wherein said polishing tool has a brush.

43. A chemical-mechanical polishing apparatus according to any one of claims 1 to 5, wherein said polishing tool has a sponge.

44. A chemical-mechanical polishing apparatus according to claim 4 or 5, wherein said at least one abrasive material supplying mechanism is made integral with said polishing tool.

45. A chemical-mechanical polishing apparatus according to claim 4 or 5, wherein said polishing tool has at least one abrasive material supply port.

46. A chemical-mechanical polishing apparatus according to claim 3, wherein the diameter of at least one of said plurality of polishing tools differs from the diameter of the other polishing tools.

47. A chemical-mechanical polishing method for polishing a workpiece, said method comprising:

holding a workpiece to be polished on a rotatable table having a surface for holding the workpiece;

rotating the rotatable table with a table drive mechanism;

providing a polishing tool being rotatable around a rotation axis and being rectilinearly movable in an axial direction alone the rotation axis;

rotating and rectilinearly moving the polishing tool with a polishing tool drive mechanism, the polishing tool drive mechanism pressing the polishing tool against the workpiece to be polished at a predetermined pressure; and removing a foreign substance on the surface of the table with a scrubber, the scrubber being located rotationally downstream of the table relative to the polishing tool, and the removal of the foreign substance by the scrubber being done during the polishing by the polishing tool.

48. A chemical-mechanical polishing method for polishing a workpiece, said method comprising:

holding a workpiece to be polished on a rotatable table having a surface for holding the workpiece;

supporting a plurality of polishing tools, selecting one of the plurality of polishing tools and conveying the selected tool to a position opposing the rotatable table, using a tool conveying mechanism;

providing individual polishing tool rotating drive mechanisms being rotatable around a rotation axis and being rectilinearly movable in an axial direction along the rotation axis for rotating and rectilinearly driving a respective one of the plurality of the polishing tools;

rotating and rectilinearly moving a respective one of the plurality of polishing tools using a corresponding polishing tool rotating drive mechanism, the polishing tool rotating drive mechanism pressing the polishing tool against the workpiece to be polished at a predetermined pressure; and removing a foreign substance on the surface of the table by a scrubber, the scrubber being located rotationally downstream of the table relative to the polishing tool.

49. A chemical-mechanical polishing method according to claim 47 or 48, further comprising successively selecting the abrasive material to be supplied during the polishing of the workpiece from among different kinds of abrasive materials and selectively changing the selected material.

50. A chemical-mechanical polishing method according to claim 49, wherein the workpiece is a semiconductor.

51. A chemical-mechanical polishing method according to claim 49, wherein the workpiece has a surface to be polished that includes at least one of an insulative film and a metallic film formed thereon.

52. A chemical-mechanical polishing method according to claim 49, further comprising supplying an alkaline liquid containing fine particles therein to the surface to be polished.

53. A chemical-mechanical polishing method according to claim 49, further comprising polishing the entirety of the surface to be polished of the workpiece.

54. A chemical-mechanical polishing method according to claim 49, further comprising polishing only a portion of the surface to be polished of the workpiece.

55. A chemical-mechanical polishing method according to claim 49, wherein the different kinds of abrasive materials differ in the grain diameter of abrasive grains of the same material.

56. A chemical-mechanical polishing method according to claim 55, wherein the workpiece is a semiconductor.

57. A chemical-mechanical polishing method according to claim 55, wherein the workpiece has a surface to be polished that includes at least one of an insulative film and a metallic film formed thereon.

58. A chemical-mechanical polishing method according to claim 55, further comprising supplying an alkaline liquid containing fine particles therein to the surface to be polished.

59. A chemical-mechanical polishing method according to claim 55, further comprising polishing the entirety of the surface to be polished of the workpiece.

60. A chemical-mechanical polishing method according to claim 55, further comprising polishing only a portion of the surface to be polished of the workpiece.

61. A chemical-mechanical polishing method according to claim 47 or 48, wherein the workpiece is a semiconductor.

62. A chemical-mechanical polishing method according to claim 61, further comprising polishing the entirety of the surface to be polished of the workpiece.

63. A chemical-mechanical polishing method according to claim 61, further comprising polishing only a portion of the surface to be polished of the workpiece.

64. A chemical-mechanical polishing method according to claim 47 or 48, wherein the workpiece has a surface to be polished that includes at least one of an insulative film and a metallic film formed thereon.

65. A chemical-mechanical polishing method according to claim 64, further comprising polishing the entirety of the surface to be polished of the workpiece.

66. A chemical-mechanical polishing method according to claim 64, further comprising polishing only a portion of the surface to be polished of the workpiece.

67. A chemical-mechanical polishing method according to claim 47 or 48, further comprising supplying an alkaline liquid containing fine particles therein to the surface to be polished.

68. A chemical-mechanical polishing method according to claim 67, further comprising polishing the entirety of the surface to be polished of the workpiece.

69. A chemical-mechanical polishing method according to claim 67, further comprising polishing only a portion of the surface to be polished of the workpiece.

70. A chemical-mechanical polishing method according to claim 47 or 48, further comprising polishing the entirety of the surface to be polished of the workpiece.

71. A chemical-mechanical polishing method according to claim 47 or 48, further comprising polishing only a portion of the surface to be polished of the workpiece.

72. A polishing apparatus comprising:

holding means, having a circular holding surface, for holding a workpiece thereon;

a polishing tool having a diameter smaller than that of the circular holding surface;

liquid supplying means for supplying polishing liquid to the holding surface; and foreign substance removing means for removing foreign substances from the holding surface, wherein said polishing tool, said liquid supplying means and said foreign substance removing means are arranged above the holding surface.

73. A method of polishing a workpiece having a circular surface to be polished, the workpiece being held on a holding surface, said method comprising the steps of:

supplying a liquid to the workpiece by a liquid supplying means;

polishing the circular surface to be polished by a polishing tool having a diameter smaller than the diameter of the surface to be polished;

removing a foreign substance on the workpiece by a foreign substance removing means;

arranging the supplying means, the polishing tool and the removing means above the holding surface; and conducting each of said steps on the holding surface.

* * * * *

UNITED STATES PATENT AND TRADEMARK OFFICE

CERTIFICATE OF CORRECTION

PATENT NO. : 6,162,112
DATED : December 19, 2000
INVENTOR(S) : Kyoichi Miyazaki, et al.

It is certified that error appears in the above-identified patent and that said Letters Patent is hereby corrected as shown below:

Column 1,
Line 42, "drawing," should read -- drawings --.

Column 4,
Line 37, "diamer" should read -- diameter --.

Column 5,
Line 46, "sponge" should read -- a sponge --.
Line 62, "a the" should read -- the --; and "metallic" should read -- a metallic --.

Column 7,
Line 53, "diametral" should read -- diametrical --.

Column 8,
Line 2, "diameticral" should read -- diametrical --.

Column 9,
Line 40, "to" (first occurrence) should be deleted.

Column 11,
Line 27, "pivotally" should read -- pivotal --.
Line 46, "pivotally" should read -- pivotal --.

Column 13,
Line 54, "an" should read -- and an --.

UNITED STATES PATENT AND TRADEMARK OFFICE

CERTIFICATE OF CORRECTION

PATENT NO. : 6,162,112
DATED : December 19, 2000
INVENTOR(S) : Kyoichi Miyazaki, et al.

It is certified that error appears in the above-identified patent and that said Letters Patent is hereby corrected as shown below:

Column 18,
Line 54, "alone" should read -- along --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*